United States Patent [19]

Pietschmann et al.

[11] 4,456,297

[45] Jun. 26, 1984

[54] DENTAL CHAIR

[75] Inventors: Helmut Pietschmann, Karlsbad; Herbert Lipp, Pfinztal, both of Fed. Rep. of Germany

[73] Assignee: Sybron Corporation, Rochester, N.Y.

[21] Appl. No.: 264,486

[22] Filed: May 18, 1981

[30] Foreign Application Priority Data

May 16, 1980 [DE] Fed. Rep. of Germany ..... 3018686

[51] Int. Cl.[3] ..... A47C 1/032

[52] U.S. Cl. ..... 297/316; 297/83; 297/361

[58] Field of Search ..... 297/361, 316, 320, 321–324, 297/330, 83, 84–87

[56] References Cited

U.S. PATENT DOCUMENTS

| | | | |
|---|---|---|---|
| 2,746,520 | 5/1956 | Ducrot | 297/322 |
| 2,925,852 | 2/1960 | Lorenz | 297/85 |
| 3,865,432 | 2/1975 | Rogers, Jr. et al. | 297/316 |
| 4,200,332 | 4/1980 | Branning | 297/316 X |

FOREIGN PATENT DOCUMENTS

| | | | |
|---|---|---|---|
| 1455009 | 11/1976 | United Kingdom | 297/330 |

*Primary Examiner*—William E. Lyddane

*Attorney, Agent, or Firm*—Robert A. Gerlach; Robert J. Bird

[57] ABSTRACT

A dental chair has its backrest connected to the seat by a scissor linkage arrangement which effects the moving together of the contiguous portions of the backrest and seat concurrently with movement of the backrest from an upright to a reclined position.

3 Claims, 4 Drawing Figures

DENTAL CHAIR

BACKGROUND OF THE INVENTION

The present invention pertains to that type of dental chair known in the art wherein the articulation of the backrest with respect to the seat of the dental chair is accomplished without relative translation of the backrest with respect to the head of the patient. In this respect, it is desirable to have the backrest pivoted with respect to the seat at some location simulating the theoretical hip joint of the patient. Without such an arrangement, the curve as traced by a point on the back of the patient's head during articulation of the backrest does not coincide with a curve traced by a corresponding point on the headrest of the chair. Thus, the headrest appears to translate with respect to the patient's head during inclination and causes discomfort to the patient.

Several arrangements are known for pivoting the backrest with respect to the seat which eliminates this relative movement. For example, the backrest may be actually pivoted to a bracket upstanding from the seat so as to locate the pivot at some level above the plane of the seat. Such construction is shown for example, in U.S. Pat. No. 3,934,929. The German No. 1,248,860 illustrates still another arrangement for eliminating the relative movement between the patient back and the backrest of the dental chair during articulation of the backrest. In this patent, the backrest has a sliding connection to the seat, so that as the backrest is articulated, it can translate with respect to the seat of the dental chair. One drawback of the construction shown in this German patent is that the linkages which support the backrest must traverse an angle which is sufficiently greater than the angle of inclination traversed by the backrest. This is a disadvantage since it is known that with the common push-pull drives used in dental chairs it is difficult to control movement over large angles approaching 180°.

Still other prior art arrangements employ a pair of linkages for connecting the backrest to the seat. The pivot points for these linkages would be at a dead center position when the backrest was fully horizontal so that at this extreme position it was difficult to control the movement of the backrest.

SUMMARY OF THE INVENTION

The present invention is a dental chair wherein the backrest is mounted to the seatrest so that there is no relative sliding motion of the patient's back with respect to the backrest of the dental chair as the backrest is articulated between its upright and reclined positions. The linkages which support the backrest to the seat are arranged such that dead center positions are avoided as the backrest is moved. Also, the links connecting the backrest to the seat are arranged to move through approximately the same angle as the backrest. Thus, the two problems solved by the present invention, namely, the avoidance of dead center position and limiting the angle of swing of connecting links to approximately the angle of inclination of the backrest, facilitates control and operation of the backrest and articulation with a conventional push-pull drive means.

DESCRIPTION OF THE PREFERRED EMBODIMENTS

Figure 1:
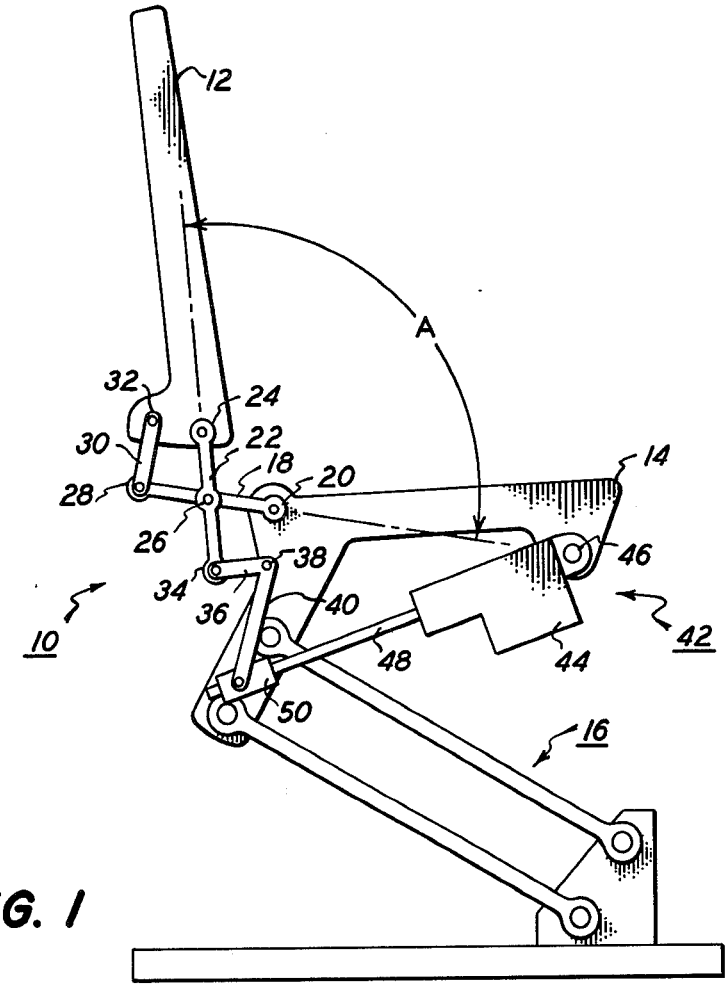
FIG. 1 is a schematic view showing a dental chair employing the connecting linkage arrangement of the present invention with the backrest in an upright position.

Referring to the drawings, FIG. 1 shows a dental chair having a lever arrangement generally indicated at 10 which connects the backrest 12 of the dental chair to the seat 14. It should be appreciated that seat 14 is supported on an elevating mechanism indicated at 16 for elevating the seat. The construction of elevating mechanism 16 is not described in detail as it forms no part of the present invention.

The lever arrangement 10 includes a first link 18 journaled at one end 20 to the rearward end of seat 14. A second link 22 is journaled at one end 24 to the backrest 12. These links 18 and 22 intersect and are pivotally connected intermediate their ends at 26 to form a scissor-type lever arrangement. The included angle formed by the scissor lever is indicated at A and has its center at the pivot joint 26 and its sides the extensions of links 18, 22 running through the respective pivot connections at link ends 20 and 24.

On the far side of scissor pivot joint 26, first link 18 has its other end 28 pivotally attached to the backrest 12 by means of a connecting rod 30. The point of attachment of connecting rod 30 to the backrest as indicated at 32 is rearward of the connection of link 22 to the backrest. This connection of first link 18 to the backrest as described allows the end 28 of the link to translate with respect to the backrest as the backrest is articulated between its upright and horizontal positions.

On the far side of scissor pivot joint 26, second link 22 has its other end 34 pivotally attached to seat 14 by means of a connecting rod 36. The point of attachment of connecting rod 36 to the seat as indicated at 38 is below the seat connection of link 18. This connection of second link 22 to the backrest as described allows the end 34 of the link to translate with respect to the seat as the backrest is articulated between its upright and horizontal positions.

Connecting rod 36 is one part of a bell crank lever which has a depending leg 40 connected to drive means 42 for articulating the backrest. This drive means can be any suitable pneumatic or mechanical drive. In the embodiment shown, the drive means includes an electric motor 44 which is pivotally attached to seat at 46. This motor is capable of turning a screw 48 clockwise or counterclockwise in order to drive a slave nut 50, the depending leg 40 of the bell crank being pivotally attached to the slave nut.

Figure 1A:
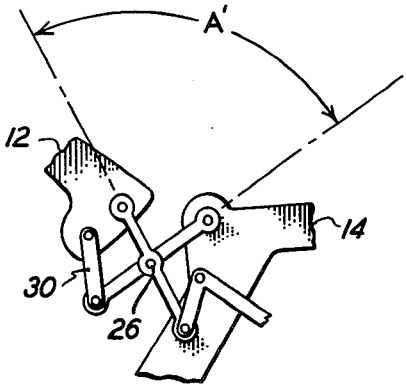
FIG. 1*a* is a view showing the connecting linkage arrangement when the backrest is tilted toward the reclining position.

In order to articulate the backrest, the electric motor 44 is operated to move slave nut 50 to the right as viewed in FIG. 1. This rotates the depending arm 44 of the bell crank lever counterclockwise about the pivot connection 38. This in turn swings the entire lever arrangement 10 downward so as to incline the backrest. Moreover, as the rotation of the bell crank is pulling the lever arrangement downward, the scissor lever closes so as to reduce the included angle A and bring the end 24 of link 22 closer to the end 20 of link 18 as shown in FIG. 1*a*. This moves the lower end of backrest 12 closer to the rearward end of seat 14 as the backrest pivots to its horizontal position. This relative translation of the backrest towards the seat reduces, if not eliminate, the relative movement of the patient's head with respect to the backrest.

As shown in FIG. 1*a*, the included angle between the seat and backrest has increased from FIG. 1 because the backrest has been tilted to a reclined position. However, the included angle A' formed by the scissor lever has in fact decreased slightly from the corresponding included angle A as shown in FIG. 1. It is also clear from FIG. 1*a* that the lower end of the backrest has moved or translated from the position shown in FIG. 1 to a position closer to the seat.

Thus, with the lever arrangement as described, the angle between the links connecting the backrest to the seat is reduced as the backrest is articulated to increase the angle between the backrest and the seat. Also, the scissor lever as described avoids any dead center position as the backrest is articulated so that the present invention does solve the two problems as set out above, namely, avoidance of dead center positions during articulation and relatively large included angles between the linkages connecting the backrest to the seat.

Figure 2:
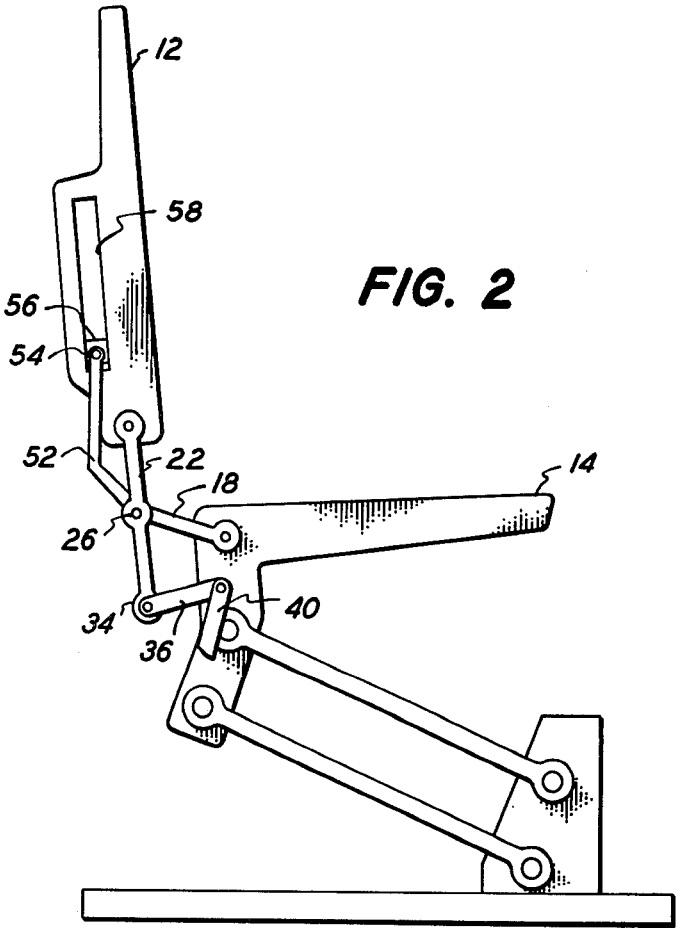
FIGS. 2 and 3 are a view similar to FIG. 1 showing different embodiments of the invention.

With respect to the embodiment as shown in FIG. 2, the same reference numerals are used to indicate parts similar to those of FIG. 1. Missing from FIG. 2 for purposes of simplification is the drive motor connected to the depending arm 40 of the bell crank lever. In this embodiment, the first link 18 on the far side of pivot connection 26 from its end 20 has a bent portion 52. The end 54 of this bent portion is pivotally attached to a slide 56. The slide is, in turn, captured in an elongated guide 58 carried by the backrest.

This embodiment operates in the same manner as that disclosed in FIG. 1 except that translation of the end of first link 18 connected to the backrest 12 is accomplished by the sliding engagement of slide 56 with guide 58.

Figure 3:
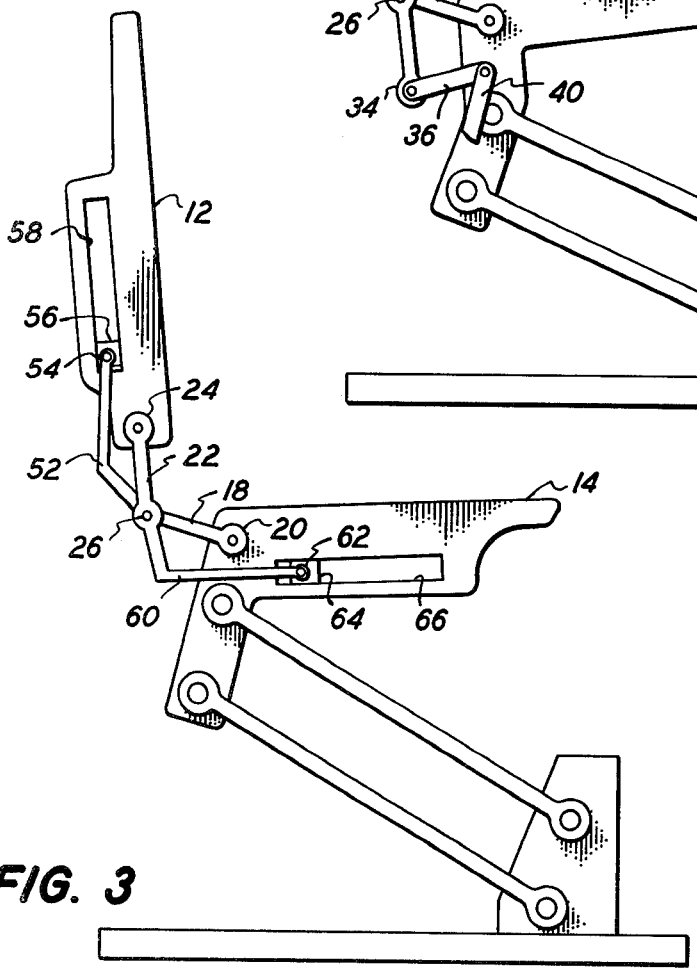

The embodiment, as shown in FIG. 3, illustrates how the present invention may be employed for the manual articulation of the backrest. Here the connection of first link 18 and second link 22 to the backrest 12 is the same as in FIG. 2. The difference is in the connection of link 22 to the seatrest. As shown in FIG. 3, this is accomplished by having the portion of link 22 on the far side of pivot connection 26 from end 24 provided with a bent arm portion 60. The end 62 of this bent arm portion is pivotally connected to a slide 64, slide 64 is, in turn, captured in a guide 66. Thus, as shown in the embodiment in FIG. 3, the connection of second link 22 to the seat is capable of translation with respect to seat 14 and the connection of link 18 to the backrest 12 is capable of translation with respect to the backrest. While a motor may be employed to articulate the backrest as with the FIGS. 1 and 2 of the embodiment, it is preferred that in FIG. 3, a friction or stepwise lock of types known in the art be used to catch and release slide 64. With this arrangement, the backrest 12 can be adjusted manually and the slide 64 locked to hold the backrest in any selected adjusted position.

Thus, it should be appreciated that the present invention provides a lever arrangement for mounting a backrest to the seat of a dental chair, the lever arrangement permitting articulation of the backrest while avoiding dead center positions and relatively large angles between the links connecting the backrest to the seat. The lever arrangement also permits articulation of the backrest in a manner which avoids relative movement between the backrest and the head of a patient.

Having described the invention in detail, what is claimed as new is:

1. A dental chair including a seat, a backrest and mechanism pivotally connecting the backrest to the seat comprising:

(a) a first link having a first end jouraled to said seat;

(b) a second link having a first end journaled to said backrest, said links crossing and being pivotally connected intermediate their ends to form a scissor linkage;

(c) a rocker arm connecting the second end of said first link to said backrest to permit arcuate displacement of the second end of said first link relative to said backrest;

(d) a crank arm connecting the second end of said second link to said seat to effect arcuate displacement of the second end of said second link relative to said seat;

(e) said mechanism being operative when said crank arm is moved in the direction away from said backrest to pivot said backrest downwardly, and concurrently said scissor linkage being operative to move the first end of said second link toward the first end of said first link.

2. A dental chair including a seat, a backrest and mechanism pivotally connecting the backrest to the seat comprising:

(a) a first link having a first end journaled to said seat, and a second end journaled to a slide which is in turn slidably mounted to said backrest;

(b) a second link having a first end journaled to said backrest, said links crossing and being pivotally connected intermediate their ends to form a scissor linkage;

(c) a crank arm connecting the second end of said second link to said seat to effect arcuate displacement of the second end of said second link relative to said seat;

(d) said mechanism being operative when said crank arm is moved in the direction away from said backrest to pivot said backrest downwardly, and concurrently said scissor linkage being operative to move the first end of said second link toward the first end of said first link.

3. A dental chair including a seat, a backrest and mechanism pivotally connecting the backrest to the seat comprising:

(a) a first link having a first end journaled to said seat and a second end journaled to a slide which is in turn slidably mounted to said backrest;

(b) a second link having a first end journaled to said backrest and a second end journaled to a slide which is in turn slidably mounted and selectively lockable relative to said seat;

(c) said links crossing and being pivotally connected intermediate their ends to form a scissor linkage;

(d) said mechanism being operable, when said second link is unlocked and slidable relative to said seat, to pivot said backrest downwardly, and concurrently said scissor linkage being operative to move the first end of said second link toward the first end of said first link.

* * * * *